United States Patent [19]

Watanabe et al.

[11] Patent Number: 4,544,922

[45] Date of Patent: Oct. 1, 1985

[54] SMOOTHING CIRCUIT FOR DISPLAY APPARATUS

[75] Inventors: Toshiaki Watanabe, Tokyo; Toshifumi Uenishi, Kamakura; Hiroshi Sahara, Yokohama; Katsumi Yamaoka, Hatogaya, all of Japan

[73] Assignee: Sony Corporation, Tokyo, Japan

[21] Appl. No.: 437,114

[22] Filed: Oct. 27, 1982

[30] Foreign Application Priority Data

Oct. 29, 1981 [JP] Japan ..... 56-173395

[51] Int. Cl.[4] ..... G09G 1/08

[52] U.S. Cl. ..... 340/728

[58] Field of Search ..... 340/728, 748, 750

[56] References Cited

U.S. PATENT DOCUMENTS 3,878,536 4/1975 Gilliam .
3,921,164 11/1975 Anderson ..... 340/750 X
3,969,716 7/1976 Roberts ..... 340/728
4,063,232 12/1977 Fernald ..... 340/750 X
4,095,216 6/1978 Spicer ..... 340/728
4,129,860 12/1978 Yonezawa et al. ..... 340/728 X
4,158,838 6/1979 Pruznick et al. ..... 340/750

*Primary Examiner*—Gerald L. Brigance
*Assistant Examiner*—Vincent P. Kovalick
*Attorney, Agent, or Firm*—Lewis H. Eslinger; Alvin Sinderbrand

[57] ABSTRACT

A desired character mainly composed of standard width dots selected from a matrix of orthogonally disposed rows and columns is displayed on a screen during scanning of the screen in horizontal and vertical directions. The display is smoothed by a circuit responsive to data stored in a memory. The smoothing involves the selected addition or removal, to or from particular portions of the character, of a small dot having a width one-third of the standard dot width.

5 Claims, 30 Drawing Figures

Y
60
70
46
OR
45
AND
47
AND
48
AND
42
41
30
43
44
31
32
33
34
A B C G2A G2B G1 Y0 Y1 Y2 Y3 Y4 Y5 Y6 Y7
A B G Y0 Y1 Y2 Y3
D(tn-1)
D(tn)
D(tn+1)
DLD
DCK
22
11
50
Pf
Pb
21
14
R(tn-1)
R(tn)
R(tn+1)
RLD
LADRS
SADRS
12
13

FCK

DCK

SADRS

Read Out

RLD

DLD
TF
TD
Tr
Td
+1, -1
0
D
R
DCK
Pf
Pb

FIG. 15

| Input | | | | | Output | | | | | | | |
|---|---|---|---|---|---|---|---|---|---|---|---|---|
| G1 | G2A G2B | C | B | A | Y0 | Y1 | Y2 | Y3 | Y4 | Y5 | Y6 | Y7 |
| X | 1 | X | X | X | 1 | 1 | 1 | 1 | 1 | 1 | 1 | 1 |
| 0 | X | X | X | X | 1 | 1 | 1 | 1 | 1 | 1 | 1 | 1 |
| 1 | 0 | 0 | 0 | 0 | 0 | 1 | 1 | 1 | 1 | 1 | 1 | 1 |
| 1 | 0 | 0 | 0 | 1 | 1 | 0 | 1 | 1 | 1 | 1 | 1 | 1 |
| 1 | 0 | 0 | 1 | 0 | 1 | 1 | 0 | 1 | 1 | 1 | 1 | 1 |
| 1 | 0 | 0 | 1 | 1 | 1 | 1 | 1 | 0 | 1 | 1 | 1 | 1 |
| 1 | 0 | 1 | 0 | 0 | 1 | 1 | 1 | 1 | 0 | 1 | 1 | 1 |
| 1 | 0 | 1 | 0 | 1 | 1 | 1 | 1 | 1 | 1 | 0 | 1 | 1 |
| 1 | 0 | 1 | 1 | 0 | 1 | 1 | 1 | 1 | 1 | 1 | 0 | 1 |
| 1 | 0 | 1 | 1 | 1 | 1 | 1 | 1 | 1 | 1 | 1 | 1 | 0 |

FIG. 16

| Input | | | Output | | | |
|---|---|---|---|---|---|---|
| G | B | A | Y0 | Y1 | Y2 | Y3 |
| 1 | X | X | 1 | 1 | 1 | 1 |
| 0 | 0 | 0 | 0 | 1 | 1 | 1 |
| 0 | 0 | 1 | 1 | 0 | 1 | 1 |
| 0 | 1 | 0 | 1 | 1 | 0 | 1 |
| 0 | 1 | 1 | 1 | 1 | 1 | 0 |

SMOOTHING CIRCUIT FOR DISPLAY APPARATUS

BACKGROUND OF THE INVENTION

1. Field of the Invention

This invention relates generally to smoothing circuits and is directed to improvements in a smoothing circuit for a display apparatus.

2. Description of the Prior Art

For transmitting information, such as news, weather forecasts, announcements or the like through the use of a telephone network or the vertical blanking period of a television broadcast, it is known to use various systems, such as, a so-called CAPTAIN (Character And Pattern Telephone Access Information Network) system, a multiplex character television broadcast and so on.

In such transmitting systems, the transmitting section converts characters, such as letters, numerals or symbols, into code signals and transmits the same, while the receiving section decodes the original characters from the received code signals and displays the same on a picture screen of a television receiver.

By way of example, in the case of the letter "A", a code signal "41" (hexadecimal code) indicating the letter "A" is converted into a binary coded signal of 8 bits for each numeral and then transmitted by the transmitting section. In the receiving section this coded signal "41" is supplied to a character memory (character generator), in which is formed a luminance signal, which will form a pattern of the letter "A" and therefore the letter "A" is displayed on the picture screen of the television receiver. Further, in the prior art, smoothing is effected to make the displayed character easy to see.

For example, FIG. 1 schematically illustrates an original pattern of the character or letter "A" as written in the character memory. This original pattern is composed of, for example, a dot matrix system consisting of $5\times7$ dots. FIG. 2 schematically illustrates the character "A" of FIG. 1 as displayed on the picture screen of the television receiver, in the case where smoothing has not been effected. Reference letters $L_1$ to $L_{14}$ ($L_{2m+1}$, $L_{2m}$, . . . m is an integer including 0) denote scanning lines, with the scanning lines shown by broken lines being formed during each odd-numbered field, while the scanning lines shown by solid lines are formed during each even-numbered field. Moreover, reference letter Du generally identifies a dot (luminance point) of standard or fundamental size, and since the output (FIG. 1) of the character memory is utilized in both the odd- and even-numbered fields, the displayed pattern is as shown in FIG. 2.

When smoothing is conducted according to the prior art, the letter "A" is displayed on the picture screen of the television receiver as shown in FIG. 3, and in which half dots Dh, each having a width one-half that of the initial or fundamental dot Du, are added to the display pattern shown in FIG. 2. Accordingly, the displayed letter "A" in FIG. 3 is smoother than the displayed letter "A" in FIG. 2, and becomes easier to recognize. For this smoothing according to the prior art, there are only two basic combinations of the half dot Dh with the standard or fundamental dot Du as shown in FIG. 4. In other words, for all characters, the half dots $D_h$ are added to the respective standard dots Du only on the basis of the combinations shown in FIG. 4.

When smoothing is conducted by adding the half dots Dh only on the basis of the two combinations shown in FIG. 4, if the original patterns are, for example, the characters shown in FIG. 5, the resulting displayed patterns become those shown in FIG. 6. It will be appreciated therefrom that, when the oblique line portion of the displayed pattern is very steep as in the letter "V" at the top of FIG. 5, the smoothness of such portion leaves much to be desired. In the case of an oblique line portion as in the symbol or slash "/" in the middle portion of FIG. 5, smoothing according to the prior art increases the boldness of that symbol more than is required for good recognition. Finally, in the case of the symbol " o " shown at the bottom of FIG. 5, the central open portion corresponding in size to a standard dot Du is filled with half dots Dh as a result of the smoothing according to the prior art, as shown at the bottom of FIG. 6.

OBJECTS AND SUMMARY OF THE INVENTION

Accordingly, it is an object of this invention to provide a smoothing circuit for a display apparatus which can avoid the previously described defects inherent in the smoothing according to the prior art.

More particularly, an object of this invention is to provide a smoothing circuit which can make the pattern of a displayed character substantially easier to recognize.

According to an aspect of this invention, a smoothing circuit for a display apparatus in which a desired character composed of selected standard width dots of a matrix of orthogonally disposed rows and columns thereof is displayed on a screen during scanning of the latter in horizontal and vertical directions, comprises: memory means for memorizing data $R(t_{n-1})$, $R(t_n)$, $R(t_{n+1})$, $D(t_{n-1})$, $D(t_n)$ and $D\ t_{n+1}$), in which D represents data selectively indicating the existence and absence of a dot in a row of said matrix being presently displayed, $(t_n)$ represents a time interval corresponding to the horizontal scanning of a space being considered in a respective row and which has a width equal to said standard width, $(t_{n-1})$ and $(t_{n+1})$ are equivalent time intervals immediately preceding and following, respectively, said time interval $(t_n)$, and R represents data selectively indicating the existence and absence of a dot in a row of said matrix which is immediately adjacent said row being presently displayed; logical operation circuit means responsive to said data memorized in said memory means for performing logical operations thereon which satisfy predetermined conditions so as to selectively alter said data $D(t_n)$ in correspondence with the addition or removal, in said space being considered, of a small dot having a width one-third of said standard width, said predetermined conditions satisfied by said logical operations being as follows:

(a) The condition for altering said data $D(t_n)$ in correspondence with the addition of said small dot in the front third of the space being considered is $$\overline{R(t_{n-1})}\cdot R(t_n)\cdot D(t_{n-1})=1$$

(b) The condition for altering said data $D(t_n)$ in correspondence with the addition of said small dot in the rear third of the space being considered is $$R(t_n)\cdot\overline{R(t_{n+1})}\cdot D(t_{n+1})=1$$

(c) The condition for altering said data $D(t_n)$ in correspondence with the removal of said small dot from the front third of a standard width dot in said space being considered is $$\overline{R(t_{n-1})}\cdot\overline{R(t_n)}\cdot R(t_{n+1})\cdot\overline{D(t_{n-1})}\cdot\overline{D(t_{n+1})}=1$$

and (d) The condition for altering data $D(t_n)$ in correspondence with the removal of said small dot from the rear third of a standard width dot in said space being considered is $$R(t_{n-1})\cdot\overline{R(t_n)}\cdot\overline{R(t_{n+1})}\cdot\overline{D(t_{n-1})}\cdot\overline{D(t_{n+1})}=1$$

and means for displaying on said screen said desired character as modified in accordance with said selectively altered data so as to provide the displayed character with relatively smooth contours.

In the case where the character is displayed on the picture screen of a television receiver or the like employing interlaced scanning during successive odd- and even-numbered fields, the data R refers to the row of the matrix which immediately precedes the row being displayed during each odd-numbered field, and the data R refers to the row of the matrix which immediately follows the row being displayed during each even-numbered field.

The above, and other objects, features and advantages of the present invention, will become apparent from the following detailed description of a preferred embodiment to be read in conjunction with the accompanying drawings in which the same or corresponding elements and parts are identified by the same references in the several views.

BRIEF DESCRIPTION OF THE DRAWINGS

FIGS. 13A–13F and FIGS. 14A–14C are waveform diagrams to which reference will be made in explaining the operation of the smoothing circuit shown in FIG. 12; and FIGS. 15 and 16 are truth tables to which reference will be made in explaining a logical operation circuit which is included in the smoothing circuit of FIG. 12.

DESCRIPTION OF THE PREFERRED EMBODIMENT

Figure 7:
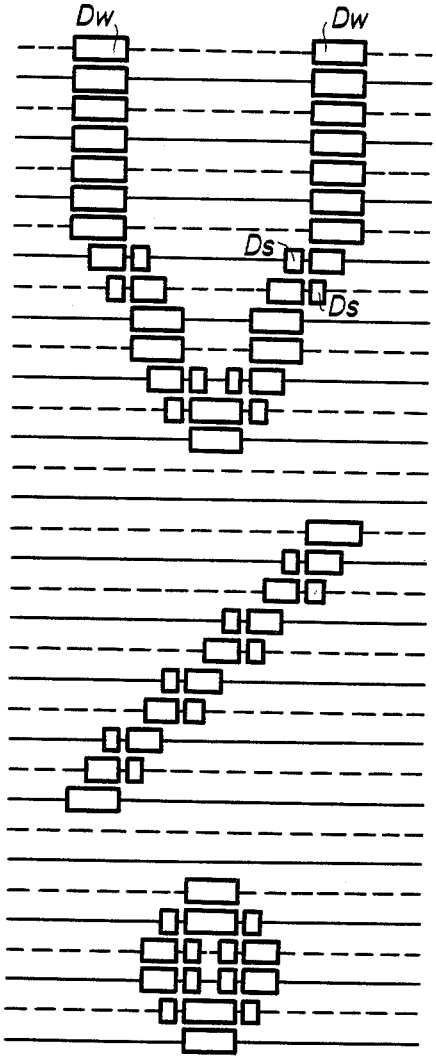
FIG. 7 shows displayed characters corresponding to the patterns of FIG. 5, but after the smoothing thereof in accordance with an embodiment of this invention.
Figure 8A:
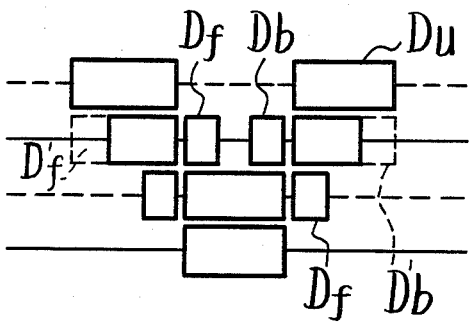
FIGS. 8A–8D are diagrams to which reference will be made in explaining smoothing of the displayed characters in accordance with this invention by the selective addition and removal of so-called "small" dots to and from, respectively, the standard-width dots.
Figure 8B:
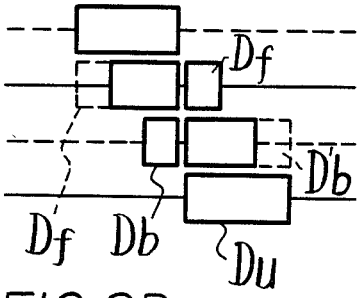
Figure 8C:
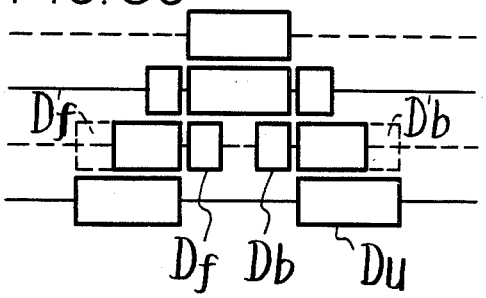
Figure 8D:
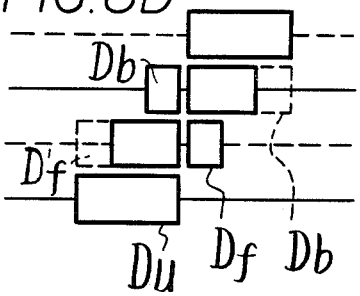
Figure 9A:
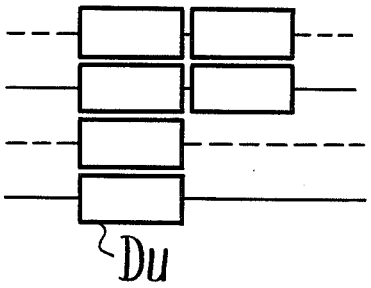
FIGS. 9A–9D are diagrams similar to those of FIGS. 8A–8D, but showing patterns of standard-width dots for which no "small" dots are either added or removed when effecting smoothing according to this invention.
Figure 9B:
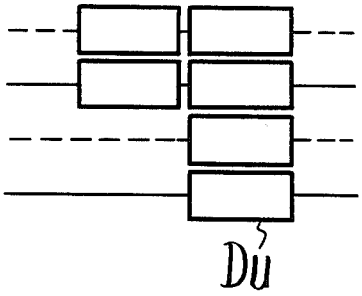
Figure 9C:
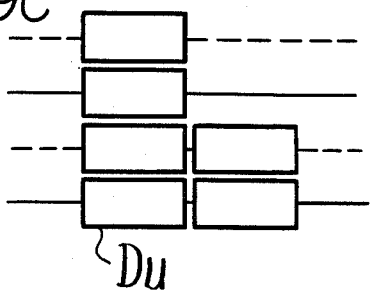
Figure 9D:
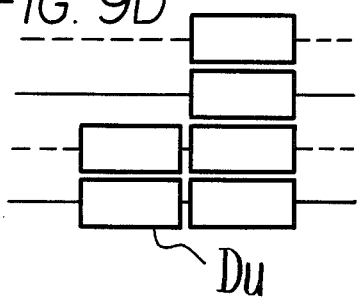

Referring to the drawings in detail, and initially to FIG. 7 thereof, it will be seen that, in accordance with this invention, so-called "small" dots identified generally at $D_s$ and each having a small width, for example, $\frac{1}{3}$ that of the standard-width dot $D_u$, are added to the displayed character, where needed, to effect smoothing thereof. Further, in accordance with this invention, certain of the standard-width dots $D_u$ have portions thereof cut out or removed for further promoting the smoothing action, with such cut-out or removed portions being equivalent in width to the small dots $D_s$. In other words, generally in accordance with this invention, small dots $D_s$, each with a width $\frac{1}{3}$ that of the standard dots $D_u$, are added to, or removed from, the standard dots $D_u$ for smoothing the displayed character.

FIGS. 8A–8D illustrate basic arrangements of the standard dots $D_u$ for which small dots are added or removed in accordance with the invention, while FIGS. 9A–9D illustrate basic arrangements of the standard dots $D_u$ for which adding and/or removing of the small dots are inhibited.

Figure 1:
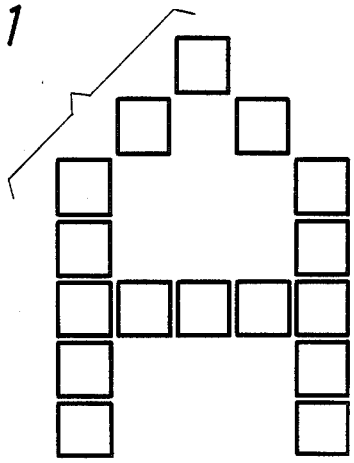
FIG. 1 PRIOR ART
FIG. 1 is a diagram schematically showing an example of an original pattern of a letter which is written in a character memory and to be displayed on the picture screen of a television receiver.
Figure 2:
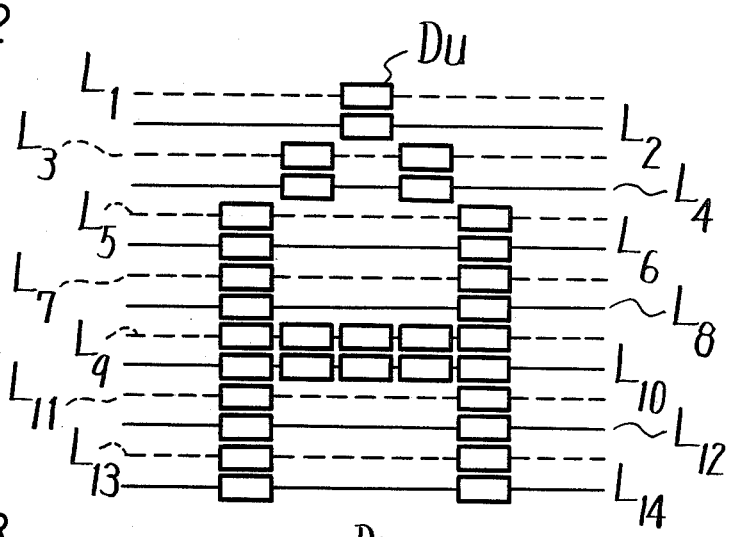
FIG. 2 PRIOR ART
FIG. 2 is a diagram showing a portion of a picture screen of a television receiver on which a letter corresponding to the original pattern of FIG. 1 is displayed without smoothing.
Figure 3:
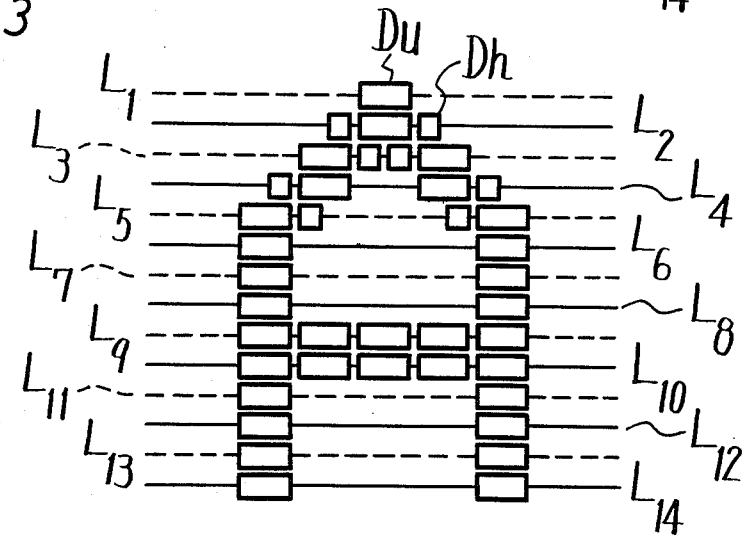
FIG. 3 PRIOR ART
FIG. 3 is a diagram similar to that of FIG. 2, but showing the letter displayed on the picture screen of the television receiver after smoothing according to the prior art.

The adding or removal of a small dot, during each odd-numbered field, is determined in response to data on the row being displayed at present and data on the immediately preceding row. On the other hand, during each even-numbered field, the adding or removal of a small dot is determined in response to data on the row being displayed at present and data on the immediately following row. In the foregoing, the terms "row being displayed", "immediately preceding row" and "immediately following row" all refer to rows of the original pattern or matrix (FIG. 1 or FIG. 5) and not to lines of the displayed pattern.

As is clear from FIGS. 7 and 8A to 8D, among the small dots $D_s$ to be added or removed there are small dots $D_f$ each positioned at the front third of a standard dot interval or space and small dots $D_b$ each placed at the back or rear third of the standard dot interval. Consequently, hereinafter, each dot $D_f$ is called a "front small dot" and each dot $D_b$ is called a "rear small dot". The conditions under which these front small dots $D_f$ and rear small dots $D_b$ are to be added or removed are as follows:

The condition under which a front small dot $D_f$ is added (FIG. 10A) is:

$$\overline{R(t_{n-1})}\cdot R(t_n)\cdot D(t_{n-1})=1 \quad (1)$$

The condition under which a rear small dot $D_b$ is added (FIG. 11A) is:

$$R(t_n)\cdot\overline{R(t_{n+1})}\cdot D(t_{n+1})=1 \quad (2)$$

The condition under which a front small dot $D_f'$ is removed (FIG. 10B) is:

$$\overline{R(t_{n-1})}\cdot\overline{R(t_n)}\cdot R(t_{n+1})\cdot\overline{D(t_{n-1})}\cdot\overline{D(t_{n+1})}=1 \quad (3)$$

The condition under which a rear small dot $D_b'$ is removed (FIG. 11B) is:

$$R(t_{n-1})\cdot\overline{R(t_n)}\cdot\overline{R(t_{n+1})}\cdot\overline{D(t_{n-1})}\cdot\overline{D(t_{n+1})}=1 \quad (4)$$

In each of the above equations or conditions (1) to (4), D represents data selectively indicating the existence and absence of a standard dot in a row of the original pattern or matrix being presently displayed, ($t_n$) represents a time interval corresponding to the horizontal scanning of a space being considered in a respective row and which has a width equal to the standard dot, ($t_{n-1}$) and ($t_{n+1}$) are equivalent time intervals immediately preceding and following, respectively, the time interval ($t_n$), and R represents data selectively indicating the existence and absence of a standard dot in a row of said matrix which immediately precedes or follows the row being presently displayed during an odd-numbered field or during an even-numbered field, respectively.

Figure 10A:
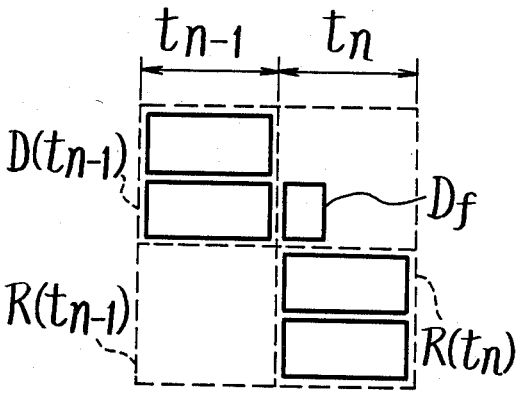
FIGS. 10A and 10B are diagrams respectively illustrating the adding and removing of a so-called "small" dot at the front portion of a space of standard width when effecting smoothing according to this invention.

Thus, during an even-numbered field, if standard dots appear in the matrix or original pattern in the time interval $t_{n-1}$, but not in the interval $t_n$, in the row D of the matrix being presently displayed and in the interval $t_n$, but not the interval $t_{n-1}$, the immediately following row R, respectively, then a small dot $D_f$ is added at the lower part in the first third of the space or time interval $t_n$ in the row being presently displayed, as shown on FIG. 10A, and as is consistent with condition (1) above. During an odd-numbered field, a small dot $D_f$ would be added at the upper part of the first or front third of the space or time interval $t_n$ corresponding to the row D of the matrix which is presently being displayed only if such matrix contained a standard dot in the time interval $t_{n-1}$ of such row D, and also a standard dot in the time interval $t_n$ of the row of the matrix which immediately precedes the row D being displayed.

Figure 11A:
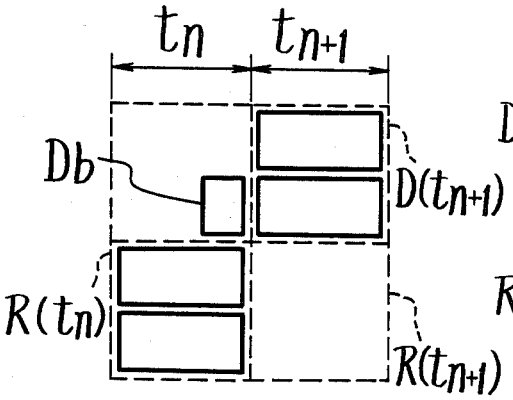
FIGS. 11A and 11B are diagrams respectively illustrating the adding and removing of a so-called "small" dot at the back portion of a space of standard-width when effecting smoothing according to this invention.
Figure 11B:
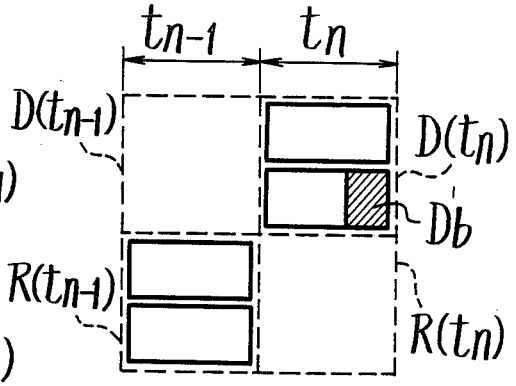

Returning to a consideration of the circumstances during each even-numbered field, a rear or back small dot $D_b$ is added at the lower part of the last third of the space or time interval $t_n$ in the matrix row D being presently displayed when the matrix shows standard dots in the time intervals $t_{n+1}$ and $t_n$ of the matrix row D and in the immediately following matrix row R, respectively, as shown on Fig. 11A, and as required by condition (2) above. Of course, in an odd-numbered field, a small dot $D_b$ would be added in the last third of the upper portion of the space or time interval $t_n$ of the row D being presently displayed when the matrix contains standard dots in the spaces or time intervals $t_{n+1}$ of the row D being presently displayed and in the interval or space $t_n$ of the matrix row which immediately precedes the row being presently displayed.

Figure 10B:
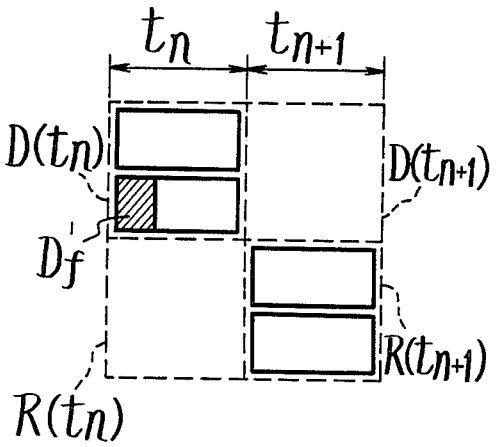

On the other hand, in an odd-numbered field, a front small dot $D'_f$ is removed from the lower portion of the standard dot in the space or time interval $t_n$ of the row D being presently displayed when such space or interval $t_n$ in the matrix row D being presently displayed and the time interval or space $t_{n+1}$ in the immediately following matrix row R contain standard dots, as shown on FIG. 10B, and as is consistent with the above indicated condition (3). Similarly, as shown on FIG. 11B and as is consistent with the above condition (4), a small dot $D_b'$ is removed from the last third of the lower portion of the space or time interval $t_n$ in the row being presently displayed when standard dots appear in the spaces or time intervals $t_n$ and $t_{n-1}$ of the matrix row D and the immediately following matrix row R, respectively.

As is shown on FIGS. 9A–9D, none of the above described conditions (1) to (4) are established, and hence a small dot is neither added, as at $D_f$ or $D_b$, nor removed, as at $D'_f$ and $D'_b$, if standard dots appear in the spaces t and $t_{n-1}$ or $t_{n+1}$ which are adjacent to each other in either the matrix row D being displayed or in the immediately adjacent matrix row R which follows the matrix row D in the case of an even field or which precedes the matrix row D in the case of an odd-numbered field (not shown).

Figure 12:
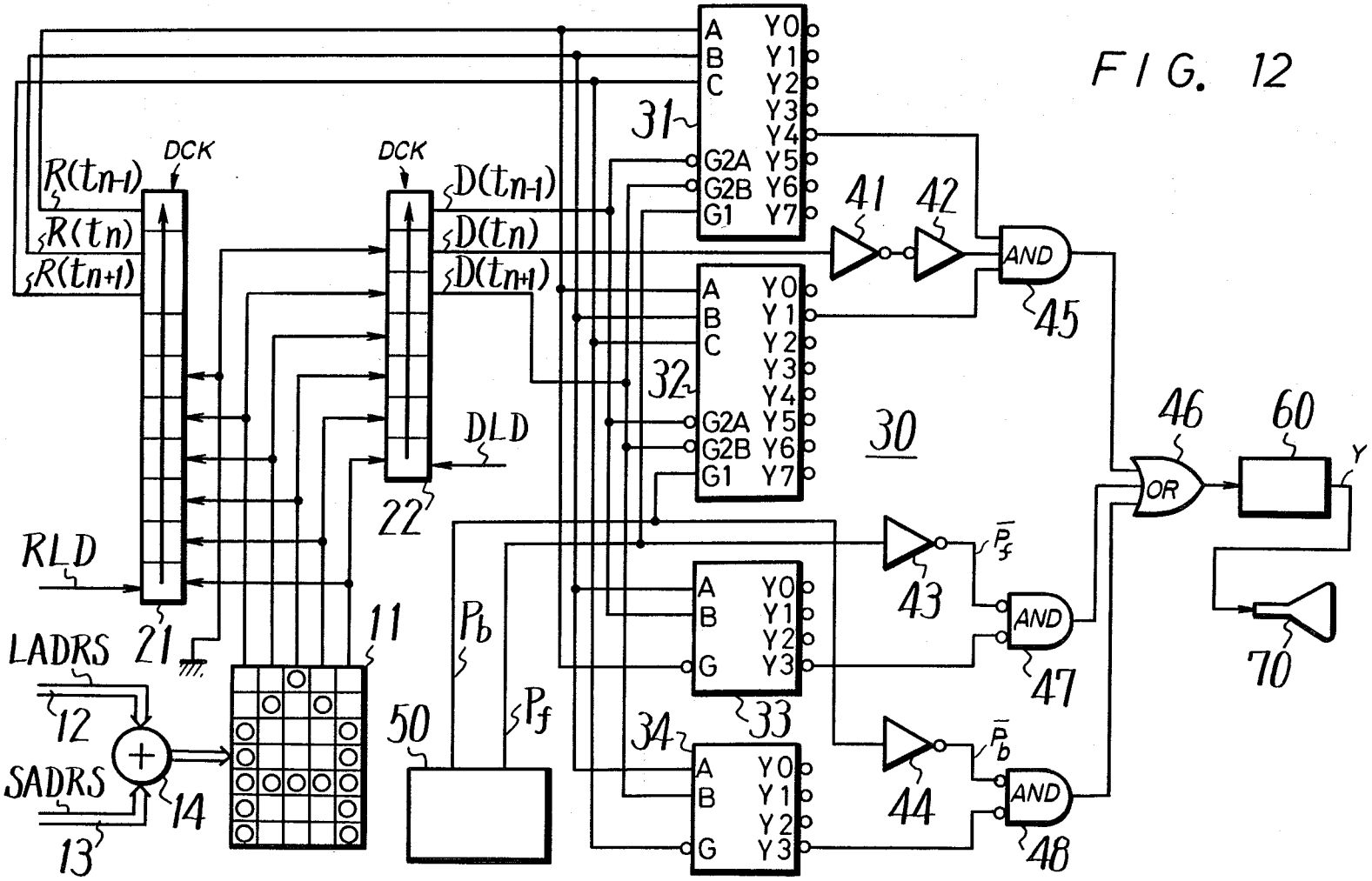
FIG. 12 is a schematic block diagram showing an embodiment of a smoothing circuit according to this invention.

Referring now to FIG. 12, it will be seen that a smoothing circuit embodying the present invention which can effect smoothing of the displayed character in accordance with the above conditions (1) to (4) is there schematically shown to comprise a character memory or generator 11 in which there is written data representing the desired character formed of a respective pattern of dots included in a matrix thereof having five columns and seven rows. FIG. 12 schematically represents data written in memory 11 to represent the letter "A" with each space or area of the matrix marked by o being at a logic level "1", while each unmarked area or space of the matrix is assumed to be at the logic level "0". The space provided between adjacent letters or characters in the row or horizontal direction, upon the display thereof, is equivalent to the width of one standard dot so that, although each character is represented by 5×7 dots, the display area for each character is 6×7 dots, with the space between characters in the vertical or column direction being ignored.

Figures 13A, 13B, 13C, 13D, 13E, 13F, 14:
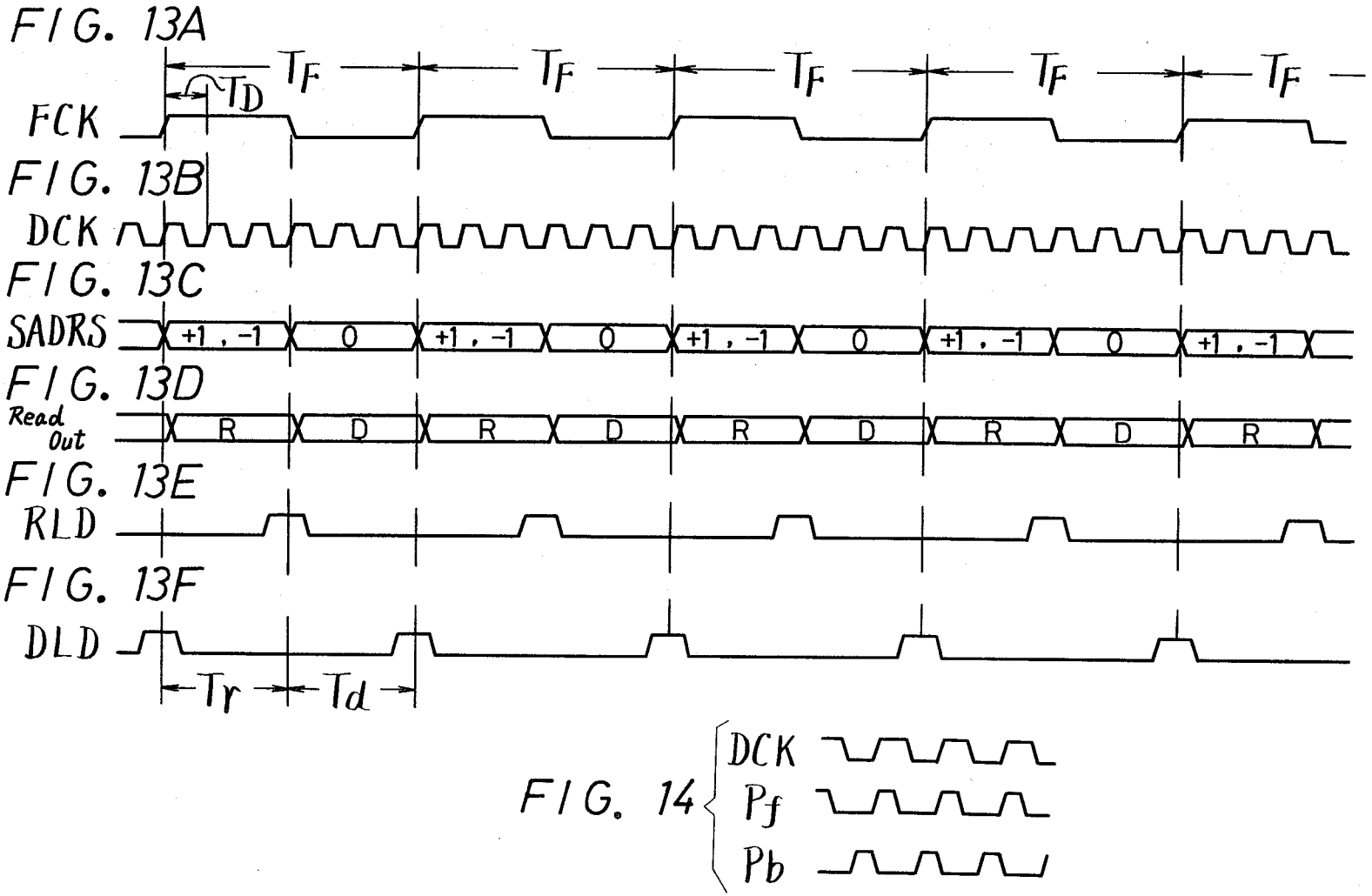

A horizontal synchronizing pulse is supplied to a counter (not shown) in which there are formed a row address signal LADRS changed at every horizontal period so as to designate the row address of the character memory 11, and a supplementary address signal SADRS (FIG. 13C). More specifically, assuming that a frame clock FCK and a dot clock DCK are as shown on FIGS. 13A and 13B, respectively, with one cycle period $T_F$ of the frame clock FCK corresponding to a period in which one row of the original pattern or matrix is displayed, and one cycle period $T_d$ of the dot clock DCK corresponding to a period in which one standard dot of the original pattern is displayed, then the supplementary signal SADRS becomes "−1" during the first half $T_r$ of each period $T_F$ in each odd-numbered field period and "0" during the second half $T_d$ of each period $T_F$. On the other hand, the supplementary address signal SADRS becomes "+1" during the first half $T_r$ of each period $T_F$ in each even-numbered field and "0" during the second half $T_d$ thereof.

As shown on FIG. 12, the address signals LADRS and SADRS are supplied through bus lines 12 and 13, respectively, to an adder 14, with the output of the latter being supplied to character memory 11 as a row address signal for designating the row address from which data is to be read.

Therefore, during the second half $T_d$ of each period $T_F$, the address of the matrix row being displayed at present is applied to character memory 11, while, during the first half $T_r$ of each period $T_F$, the address applied to character memory 11 is the address of the row which is immediately adjacent the row being presently displayed and which precedes the latter, in the case of an odd-numbered field, or follows the row being presently displayed, in the case of an even-numbered field. Therefore, as shown on FIG. 13D, during the first half $T_r$ of each period $T_F$, the reference data is read out in parallel, that is, five bits at a time, from the row R, whereas, during the second half $T_d$ of the period $T_F$, the display data is read out, in parallel, that is, five bits at a time, from the row D being presently displayed. Although the reference data and the display data read out of rows R and D of memory 11 are parallel data each made up of five bits, as just described, a bit of "0" logic level is added thereto to achieve the space between successive characters, so that the data indicated at R and D on FIG. 13D are parallel data of six bits each.

The six-bit parallel data are supplied parallely to a reference data shift register 21 of ten bit capacity which also receives a load pulse RLD (FIG. 13E) so that the reference data R generated during each period $T_r$ are parallely loaded into shift register 21. The six-bit parallel data read out of character memory 11 are also supplied parallely to a display data shift register 22 of seven bit capacity. At the end of each half period $T_d$, a data load pulse DLD (FIG. 13F) is applied to register 22 by which the display data D read out from memory 11 during the preceding half period $T_d$ are parallely loaded into register 22. The dot clock DCK (FIG. 13B) is applied, as a shift clock, to shift registers 21 and 22 so that the reference data R and the display data D are serially shifted in registers 21 and 22, as indicated by the arrows on FIG. 12. Thus, shift register 21 provides reference data $R(t_{n-1})$, $R(t_n)$ and $RT(t_{n+1})$ concurrently or in parallel and, at the same time, shift register 22 provides display data $D(T_{n-1})$, $D(t_n)$ and $D(t_{n+1})$ also in a concurrent or parallel fashion. Such reference and display data provided by shift registers 21 and 22 are supplied to a logical operation circuit 30 which selectively modifies the display data by the addition of front and rear small dots $D_f$ and $D_b$ or by the removal of front and rear small dots $D'_f$ and $D'_b$ in accordance with the above described conditions (1) to (4). In the embodiment of the invention illustrated on FIG. 12, the logical operation circuit 30 is comprised of decoders 31 and 32 each operating on the basis of a truth table shown in FIG. 15 and decoders 33 and 34 which each operate on the basis of the truth table shown in FIG. 16. More particularly, each of decoders 31 and 32 may be an IC device of the type available from Texas Instruments Incorporated under the designation 74LS138, and is shown to have inputs A, B and C which respectively receive the data $R(t_{n-1})$, $R(t_n)$ and $R(t_{n+1})$ from register 21. Decoders 31 and 32 each also have input terminals G2A and G2B which respectively receive the data $D(t_{n-1})$ and $D(t_{n+1})$ from register 22. In the truth or function of FIG. 15, G2=G2A+G2B. Finally, decoders 31 and 32 have input terminals G1 respectively receiving dot pulses $P_f$ and $P_b$ from a pulse generating circuit 50. As shown on FIG. 14B, each dot pulse $P_f$ is located at the front third of a one-cycle period $T_d$ of dot clock DCK (FIG. 14A) and defines the width and location of each added front small dot $D_f$ and of each removed front small dot $D_f'$. Further, as shown on FIG. 14C, each dot pulse $P_b$ is located at the rear third of the period $T_d$ so as to define the position and width of each added rear small dot $D_b$ and of each removed rear small dot $D'_b$.

As further shown on FIG. 12, decoders 33 and 34, which should be IC devices of the type available from Texas Instruments Incorporated under the designation 74LS139, have input terminals A which, in both cases, receive data $R(t_n)$ from register 21, input terminals B receiving display data $D(t_{n-1})$ in the case of decoder 33, and display data $D(t_{n+1})$ in the case of decoder 34, and also input terminals G receiving reference data $R(t_{n-1})$ in the case of decoder 33 and reference data $R(t_{n+1})$ in the case of decoder 34. Outputs Y4 and Y1 of decoders 31 and 32, respectively, are connected to first and second inputs, respectively, of an AND circuit 45 which, at a third input thereof, receives display data $D(t_n)$ from register 22 through successive inverters 41 and 42 acting as a delay circuit for obtaining timed correspondence of such display data $D(t_n)$ from register 22 with the data obtained from outputs Y4 and Y1 of decoders 31 and 32. The dot pulses $P_f$ and $P_b$ are further shown to be supplied from pulse generating circuit 50 through inverters 43 and 44, respectively, to first inverting inputs of AND circuits 47 and 48, respectively. Such AND circuits 47 and 48 have second inverting inputs which are connected to receive the outputs Y3 of decoders 33 and 34, respectively. The outputs of AND circuits 45,47 and 48 are connected to respectively inverting inputs of an OR circuit 46 having its output connected through an amplifier 60 to a cathode ray tube 70.

It will be appreciated that, by reason of the connections described above with reference to FIG. 12 and the operation of decoders 31 and 32 and decoders 33 and 34 in accordance with the truth tables of FIGS. 15 and 16, respectively, there is obtained at the output of OR circuit 46, and through amplifier 60 to cathode ray tube 70, a luminance signal Y which corresponds to the character represented by the data read out of memory 11, and in which front small dots and/or rear small dots have been added or removed, as at $D_f$ and $D_b$ or as at $D'_f$ and $D'_b$ on FIGS. 8A-8D and on FIGS. 10A and 10B and FIGS. 11A and 11B, in accordance with the above described conditions (1) to (4).

Figure 5:
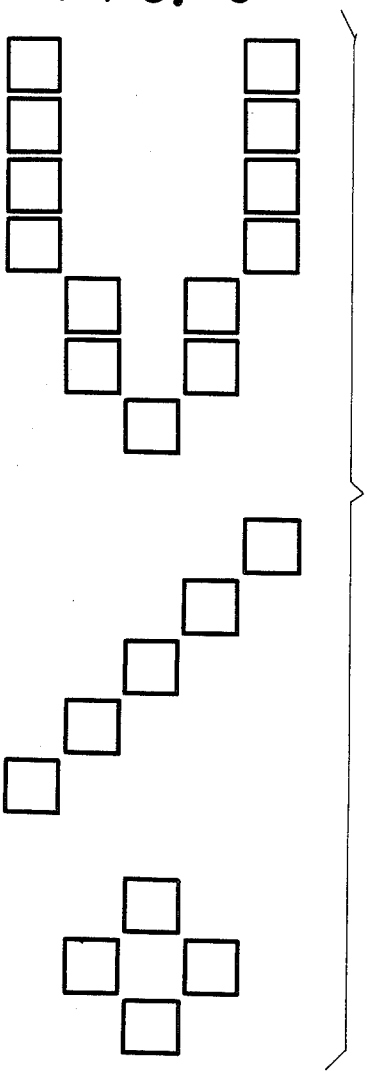
FIG. 5 shows other original patterns which are written in a character memory and are to be displayed.
Figure 6:
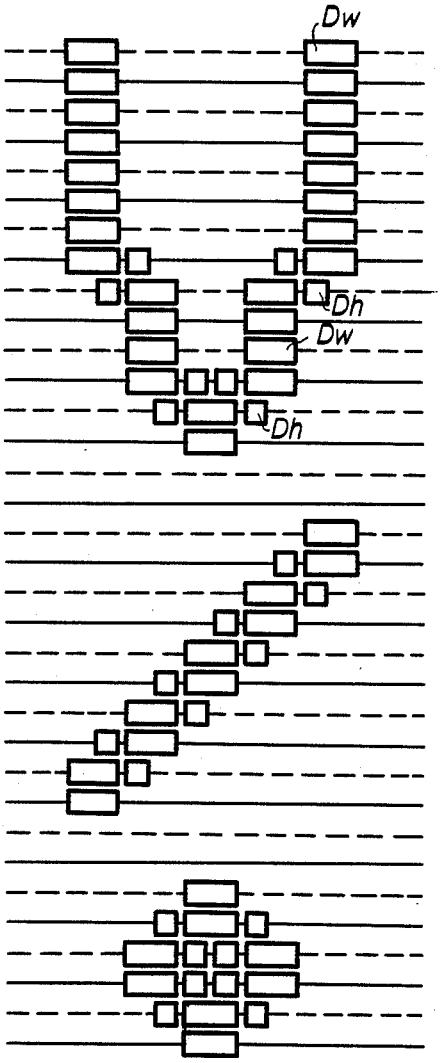
FIG. 6 PRIOR ART
FIG. 6 shows displayed characters corresponding to the patterns of FIG. 5 after smoothing in accordance with the prior art.

Since, according to this invention, the small dots $D_f$, $D_b$, $D'_f$ and $D'_b$ each have a width which is one-third that of the standard dot $D_u$ and are added to, or removed from a standard dot $D_u$ on the basis of the described conditions (1) to (4), the character displayed on the screen of cathode ray tube 70, for example, as shown on FIG. 7, will have its contours smoothed and will otherwise be of improved clarity. Thus, even if an oblique line portion of the displayed character is relatively steep, for example, as at the mid-portion of FIG. 7, such steep portion has relatively smooth contours and is not of undesirably increased boldness or thickness. Furthermore, if the character to be displayed has a central opening of a size equivalent to that of a single standard dot $D_u$, for example, as shown at the bottom of FIG. 5, such opening or space is not closed by the smoothing action, for example, as indicated at the bottom of FIG. 7.

Although data is read out from character memory 11 twice during each frame clock period $T_f$ in the illustrated embodiment of the invention, that is, reference data R is read out at the end of the half period $T_r$ and applied to register 21 in response to load pulse RLD, and display data D is read out at the end of the half period $T_d$ and loaded in register 22 in response to loading pulse DLD, an apparatus according to this invention may have read out of the reference data and display data occurring only once during each frame clock period. In such case, for example, two character memories may be provided for storing the display data and reference data, respectively, whereupon the display data and the reference data may be read out simultaneously from the respective character memories. Alternatively, in an apparatus having only a single character memory, a shift register of one horizontal line capacity may be provided to delay the output data from the character memory by one horizontal line, whereupon the resulting delayed output data and the data obtained directly from the character memory are employed as the display data and the reference data, respectively, or as the reference data and the display data, respectively, in dependence upon whether an odd-numbered or even-numbered field is involved. In those cases where the smoothing circuit according to the invention employs reading of the display data D and the reference data R from the character memory only once during each frame clock period $T_F$, a relatively low speed character memory can be conveniently utilized.

Furthermore, when it is not necessary to provide a space between successively displayed characters, for example, when displaying a graphic pattern other than numbers or letters, if the bit capacity of shift registers 21 and 22 is increased by one bit, in each case, it is possible to also smooth the displayed characters at the boundary therebetween.

Figure 4A:
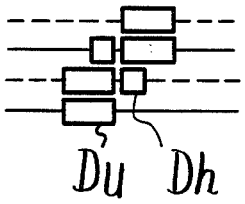
FIG. 4A PRIOR ART
FIGS. 4A and 4B are diagrams showing examples of fundamental combinations of standard-width dots with half-width dots to effect smoothing according to the prior art.
Figure 4B:
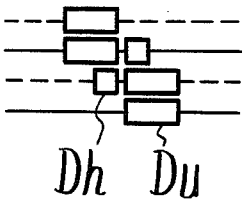
FIG. 4B PRIOR ART

Furthermore, instead of effecting smoothing by the addition or removal of a front small dot $D_f$, $D'_f$ and/or a rear small dot $D_b$, $D'_b$, a similar effect can be achieved by changing the luminance or intensity of the dots making up the displayed character. In such case, a standard dot may have a width equal to one-half the width of a space in the displayed character corresponding to a dot of the matrix, for example, as in the case of the half dot $D_h$ on FIG. 4, and the basic combination is made up of two of such half dots with one of such half dots being of uniform intensity and the other half dot having its luminance or intensity varied as required for smoothing of the character.

Although an embodiment of this invention and a number of modifications thereof have been described in detail herein with reference to the accompanying drawings, it is to be understood that the invention is not limited to that precise embodiment and the specifically described modifications, and that various changes and further modifications may be effected therein by one skilled in the art without departing from the scope or spirit of the invention as defined in the appended claims.

What is claimed is:

1. A smoothing circuit for a display apparatus in which a desired character composed of selected standard width dots of a matrix of orthogonally disposed rows and columns thereof is displayed on a screen during scanning of the latter in horizontal and vertical directions; comprising:

memory means for memorizing data $R(t_{n-1})$, $R(t_n)$, $R(t_{n+1})$, $D(t_{n-1})$, $D(t_n)$ and $D(t_{n+1})$, in which D represents data indicating the presence or absence of a dot in a row of said matrix being currently displayed, $(t_n)$ represents a time interval corresponding to the horizontal scanning of a space being considered in a given one of said rows and which has a width equal to that of each of said dots, $(t_{n-1})$ and $(t_{n+1})$ are equivalent time intervals immediately preceding and following, respectively, said time interval $(t_n)$, and R represents data indicating the presence or absence of a dot in a row of said matrix which is immediately adjacent to said row being currently displayed;

logical operation circuit means responsive to said data memorized in said memory means for performing logical operations thereon which satisify predetermined conditions so as to selectively alter said data $D(t_n)$ in correspondence with the addition or removal, in said space being considered, of a small dot having a width one-third of said standard width, said predetermined conditions satisfied by said logical operations being as follows:

(a) The condition for altering said data $D(t_n)$ in correspondence with the addition of said small dot in the front third of said space being considered is $$\overline{R(t_{n-1})}\cdot R(t_n)\cdot D(t_{n-1})=1$$

(b) The condition for altering said data $D(t_n)$ in correspondence with the addition of said small dot in the rear third of said space being considered is $$R(t_n)\cdot\overline{R(t_{n+1})}\cdot D(t_{n+1})=1$$

(c) The condition for altering said data $D(t_n)$ in correspondence with the removal of said small dot from the front third of a standard width dot in said space being considered is $$\overline{R(t_{n-1})}\cdot\overline{R(t_n)}\cdot R(t_{n+1})\cdot\overline{D(t_{n-1})}\cdot\overline{D(t_{n+1})}=1$$

and (d) The condition for altering said data $D(t_n)$ in correspondence with the removal of said small dot from the rear third of a standard width dot in said space being considered is $$R(t_{n-1})\cdot\overline{R(t_n)}\cdot\overline{R(t_{n+1})}\cdot\overline{D(t_{n-1})}\cdot\overline{D(t_{n+1})}=1$$

and means for displaying on said screen said desired character as modified in accordance with said selectively altered data so that the displayed character has relatively smooth contours.

2. A smoothing circuit according to claim 1; in which said character is displayed in alternately occurring odd- and even-numbered fields, and said data R refers to the row of said matrix which immediately precedes said row being presently displayed during each said odd-numbered field and which immediately follows said row being presently displayed during each said even-numbered field.

3. A smoothing circuit according to claim 2; in which said screen is included in a cathode ray tube; and further comprising means responsive to said selectively altered data for generating a luminance signal for said cathode ray tube.

4. A smoothing circuit according to claim 1; in which said memory means includes a character memory having addresses corresponding to said rows and columns of said matrix, and register means for receiving said data $R(t_{n-1})$, $R(t_n)$, $R(t_{n+1})$, $D(t_{n-1})$, $D(t_n)$ and $D(t_{n+1})$ from said character memory.

5. A smoothing circuit according to claim 4; in which said logical operation circuit means includes pulse generating means providing first and second pulses at the front and rear thirds, respectively, of each said space being considered, decoding means receiving said first and second pulses and said data $R(t_{n-1})$, $R(t_n)$, $R(t_{n+1})$, $D(t_{n-1})$ and $D(t_{n+1})$ from said register means and providing respective predetermined outputs therefrom, and logic elements receiving said outputs from said decoding means and said data $D(t_n)$ from said register means for providing said selectively altered data therefrom.

* * * * *

UNITED STATES PATENT AND TRADEMARK OFFICE

CERTIFICATE OF CORRECTION

PATENT NO. : 4,544,922

DATED : October 1, 1985

INVENTOR(S) : Toshiaki Watanabe et al.

It is certified that error appears in the above-identified patent and that said Letters Patent is hereby corrected as shown below:

Title page, Item [73] change "Sony Corporation, Tokyo, Japan" to --Sony Corporation, Tokyo, Japan; Nippon Telegraph & Telephone Corporation, Tokyo, Japan--.

Signed and Sealed this

Second Day of December, 1986

*Attest:*

DONALD J. QUIGG

*Attesting Officer*

*Commissioner of Patents and Trademarks*